US007835538B2

(12) United States Patent
Inoue et al.

(10) Patent No.: US 7,835,538 B2
(45) Date of Patent: Nov. 16, 2010

(54) LOUDSPEAKER

(75) Inventors: Takeru Inoue, Neyagawa (JP); Mamoru Sekiya, Neyagawa (JP)

(73) Assignee: Onkyo Corporation, Neyagawa-shi (JP)

( * ) Notice: Subject to any disclaimer, the term of this patent is extended or adjusted under 35 U.S.C. 154(b) by 170 days.

(21) Appl. No.: 12/361,093

(22) Filed: Jan. 28, 2009

(65) Prior Publication Data

US 2009/0214075 A1 Aug. 27, 2009

(30) Foreign Application Priority Data

Feb. 27, 2008 (JP) ..... 2008-046788

(51) Int. Cl.
*H04R 25/00* (2006.01)

(52) U.S. Cl. ..... 381/423; 381/424; 381/430

(58) Field of Classification Search ..... 381/281, 381/186, 398, 403, 407, 423, 424, 429, 430, 381/432; 181/157, 161, 163, 164, 165, 171; 29/594, 609.1

See application file for complete search history.

(56) References Cited

U.S. PATENT DOCUMENTS

| | | | | |
|---|---|---|---|---|
| 4,132,872 | A * | 1/1979 | Inoue | 381/424 |
| 6,757,404 | B2 * | 6/2004 | Takewa et al. | 381/430 |
| 7,567,684 | B2 * | 7/2009 | Ono et al. | 381/424 |
| 7,756,287 | B2 * | 7/2010 | Abe | 381/423 |
| 2006/0062422 | A1 | 3/2006 | Ono et al. | |

FOREIGN PATENT DOCUMENTS

| | | | |
|---|---|---|---|
| JP | 58-149898 | U | 10/1983 |
| JP | 59-187291 | U | 12/1984 |
| JP | 59-221100 | A | 12/1984 |
| JP | 62-150997 | | 7/1987 |
| JP | 64-12699 | A | 1/1989 |
| JP | 8-9492 | A | 1/1996 |
| JP | 9-247791 | | 9/1997 |
| JP | 11-88987 | A | 3/1999 |
| JP | 2000-350290 | A | 12/2000 |
| JP | 3846497 | | 11/2006 |

* cited by examiner

*Primary Examiner*—Huyen D Le
(74) *Attorney, Agent, or Firm*—Renner, Otto, Boisselle & Sklar, LLP

(57) ABSTRACT

The loudspeaker includes a dome diaphragm that is made of a base material impregnated in a thermosetting resin; a cone diaphragm whose outer circumference side end portion is coupled with an outer circumference end portion of the dome diaphragm; and a voice coil having a bobbin whose one end is coupled to a back surface of the dome diaphragm, and whose outer curved surface is coupled with an inner circumference end portion of the cone diaphragm, wherein the dome diaphragm is provided with a plurality of cone-shaped projections that is formed by hardening the thermosetting resin, projecting from the back surface, and disposed in a circular pattern with a space between each other, the plurality of cone-shaped projections defining a coupling portion to which the one end of the bobbin is coupled.

5 Claims, 6 Drawing Sheets

LOUDSPEAKER

BACKGROUND OF THE INVENTION

1. Field of the Invention

The present invention relates to loudspeakers that utilize a diaphragm having high joining strength to a voice coil bobbin, and more specifically to a loudspeaker in which a dome diaphragm made of a base material impregnated in a thermosetting resin is exposed to a front side, and a cone diaphragm and a voice coil bobbin are both coupled to the dome diaphragm.

2. Description of the Related Art

In many cases, loudspeakers employ an assembly structure in which an end of an inner circumference of a loudspeaker diaphragm (especially, cone-shaped diaphragm) is joined with adhesive to a side wall of a cylindrical voice coil bobbin. In some conventional loudspeakers, various efforts are made to the assembly structure in order to reduce the number of assembling steps. Further, as adhesive strength between a voice coil bobbin and a loudspeaker diaphragm in a loudspeaker affects characteristics of sound to be played, various efforts have been made in order to improve the adhesive strength.

As one of such efforts, the applicant of the present invention has provided a loudspeaker diaphragm that can improve the adhesive strength between a voice coil bobbin and a loudspeaker diaphragm (Japanese Patent No. 3846497). As shown in FIG. 2 of Japanese Patent No. 3846497, a loudspeaker diaphragm 5 includes a first diaphragm section 5, a second diaphragm section 6 integrally formed with the first diaphragm section 5, and an attachment 7 that is provided protrudingly toward a back side of a joint portion between the first diaphragm section 5 and the second diaphragm section 6 and to which one end of a voice coil bobbin is attached. The first diaphragm section 5 and the second diaphragm section 6 are made of a base material that is impregnated in a thermosetting resin, and the attachment 7 is formed by hardening the thermosetting resin. This loudspeaker diaphragm reduces a loss in transmission of driving force from the voice coil bobbin, and accordingly, a loudspeaker employing this loudspeaker diaphragm can improve the S/N ratio.

Moreover, as another effort, a loudspeaker has been provided in which a cone diaphragm and a bobbin of a voice coil are both coupled to a dome diaphragm. Typically, for example, such a loudspeaker is allowed to expand high-pass limiting frequencies, and to extend and connect the bobbin of the voice coil to a portion in the vicinity of a joint of vibration of the dome diaphragm so as to obtain a smooth sound pressure response over broad band frequencies, and to connect an outer circumference of the dome diaphragm to a portion in the vicinity of a joint of vibration of the cone diaphragm (Japanese Laid-Open Patent Publication No. S62-150997).

Furthermore, an inverted dome loudspeaker, whose shape of the diaphragm in a front vertical cross-sectional view is such that a curved surface is protruded downwardly in a dome shape, has been provided, in which a diaphragm 1 is formed by injection molding with a thermoplastic resin as a main material, a rib group 15 including a plurality of ribs 15a, 15b, 15c, 15d, and . . . provided in a concentric pattern is disposed on a back side of the diaphragm 1, a voice coil bobbin 2 is fixedly attached to the diaphragm 1 using one of the ribs of the rib group 15 as a guide, and a ring-shaped throat 22 is provided between the voice coil bobbin 2 and a different rib of the rib group 15 (Japanese Laid-Open Patent Publication No. H09-247791).

However, in a loudspeaker having the structure as shown in FIG. 3 of Japanese Laid-Open Patent Publication No. H09-247791, as described in paragraph 0021 of the specification, "in some cases, in order to adjust desired characteristics, the diaphragm land the voice coil bobbin 2 are connected only by adhesion between the diaphragm 1 and the throat 22, and the voice coil bobbin 2 and the diaphragm 1 are not directly attached". As can be seen from the description "workability is improved" in the same paragraph, this is due to the fact that it is extremely difficult, for a loudspeaker designed such that a cone diaphragm and a bobbin of a voice coil are both coupled to a dome diaphragm, to produce stable loudspeakers in which an end of the outer circumference of the cone diaphragm is closely coupled to the dome diaphragm, and the bobbin of the voice coil is closely coupled to the dome diaphragm because the production is affected by dimensional tolerance and assembly tolerance of components for the dome diaphragm, the cone diaphragm, and the bobbin of the voice coil. Specifically, in the production of a loudspeaker having a dome diaphragm and a cone diaphragm, due to variations in the tolerance for components, there can be such problems in which a back side of the dome diaphragm and the bobbin of the voice coil are spaced apart, the end of the outer circumference of the dome diaphragm and the end of the outer circumference of the cone diaphragm are spaced apart, and either the dome diaphragm or the cone diaphragm is deformed and the diaphragms are coupled with a stress being applied therebetween. This disadvantageously hinders stable production of loudspeakers, resulting in deterioration of playback sound quality.

The present invention is contrived in order to address the problems found in the conventional techniques listed above, relating to loudspeakers in which a cone diaphragm and a bobbin of a voice coil are both coupled to a dome diaphragm. An object of the present invention is to provide a loudspeaker that can be stably produced, in which adhesive strength between the dome diaphragm, the cone diaphragm, and the bobbin of the voice coil that constitute a vibration system is high, and whose playback sound quality is excellent with a small peak dip in sound pressure frequency characteristics.

SUMMARY OF THE INVENTION

A loudspeaker comprising a dome diaphragm that is made of a base material impregnated in a thermosetting resin, a cone diaphragm whose outer circumference side end portion is coupled with an outer circumference end portion of the dome diaphragm; and a voice coil having a bobbin whose one end is coupled to a back surface of the dome diaphragm, and whose outer curved surface is coupled with an inner circumference end portion of the cone diaphragm, wherein the dome diaphragm is provided with a plurality of cone-shaped projections that is formed by hardening the thermosetting resin, projecting from the back surface, and disposed in a circular pattern with a space between each other, the plurality of cone-shaped projections defining a coupling portion to which the one end of the bobbin is coupled.

Preferably, the loudspeaker according to above, wherein, a height of each of the plurality of cone-shaped projections provided for the dome diaphragm is set greater than a sum of maximum values of absolute values respectively of height tolerance of the dome diaphragm, height tolerance of the cone diaphragm, and height tolerance of the bobbin of the voice coil, and a cone radius defining each cone-shaped projection is set greater than a maximum value of an absolute value of radius tolerance of the bobbin.

Preferably, the loudspeaker further comprising an edge whose inner circumference end portion is coupled to the outer circumference end portion of the cone diaphragm, a damper whose inner circumference end portion is coupled to the outer curved surface of the bobbin of the voice coil, a frame to which the outer circumference end portion of the edge and the outer circumference end portion of the damper are coupled, and a magnetic circuit to which the frame is coupled, the magnetic circuit having a magnetic gap in which a coil of the voice coil is provided.

More preferably, the loudspeaker according to above, wherein the dome diaphragm is further provided with an engagement flange along the outer circumference end portion, the engagement flange engaging with one of the outer circumference end portion of the cone diaphragm and an annular recess defined by a movable supporting portion of the edge.

Preferably, the loudspeaker according to above, wherein the cone diaphragm is further provided with a plurality of through holes in the vicinity of the inner circumference end portion of the cone diaphragm.

Preferably, the loudspeaker according to above, wherein the base material of the dome diaphragm contains one of woven fabric and nonwoven fabric made of fibers, and the thermosetting resin contains an unsaturated polyester resin.

Now, effects of the present invention are described.

The loudspeaker according to the present invention includes a dome diaphragm that is made of a base material impregnated in a thermosetting resin; a cone diaphragm whose outer circumference side end portion is coupled with an outer circumference end portion of the dome diaphragm; and a voice coil having a bobbin whose one end is coupled to a back surface of the dome diaphragm, and whose outer curved surface is coupled with an inner circumference end portion of the cone diaphragm. Preferably, the loudspeaker according to the present invention further includes an edge whose inner circumference end portion is coupled to the outer circumference end portion of the cone diaphragm; a damper whose inner circumference end portion is coupled to the outer curved surface of the bobbin of the voice coil; a frame to which the outer circumference end portion of the edge and the outer circumference end portion of the damper are coupled; and a magnetic circuit to which the frame is coupled, the magnetic circuit having a magnetic gap in which a coil of the voice coil is provided, thereby configuring an electrodynamic loudspeaker. The dome diaphragm can be further provided with an engagement flange containing the base material or the thermosetting resin along the outer circumference end portion, and the engagement flange can engage with one of the outer circumference end portion of the cone diaphragm and an annular recess defined by a movable supporting portion of the edge.

The base material of the dome diaphragm preferably contains one of woven fabric and nonwoven fabric made of fibers, and formed by hardening the thermosetting resin that is an unsaturated polyester resin. Because the dome diaphragm is provided with a plurality of cone-shaped projections projecting from the back surface side, and disposed in a circular pattern with a space between each other, the plurality of cone-shaped projections formed by hardening the thermosetting resin define a coupling portion to which the one end of the bobbin is coupled. The dome diaphragm and the bobbin of the voice coil are coupled with adhesive. As a result, the outer circumference end portion of the dome diaphragm is coupled to the outer circumference side end portion of the cone diaphragm, and the one end of the bobbin is coupled to the back surface of the inner circumference side. Accordingly, even with a thin and light weighted dome diaphragm, the dome diaphragm and the cone diaphragm including a paper material formed by papermaking form a rigid vibration system having a high adhesive strength with the bobbin of the voice coil. Thus, it is possible to realize a loudspeaker whose playback sound quality is excellent with a small peak dip in sound pressure frequency characteristics.

The height of each of the plurality of cone-shaped projections is set greater than a sum of maximum values of absolute values respectively of height tolerance of the dome diaphragm, height tolerance of the cone diaphragm, and height tolerance of the bobbin of the voice coil, and a cone radius defining each cone-shaped projection is set greater than a maximum value of an absolute value of radius tolerance of the bobbin. Specifically, in the loudspeaker according to the present invention, the coupling portion to which the one end of the bobbin is constituted by the plurality of cone-shaped projections defined in consideration of the dimensional and assembly tolerance of the components to which the bobbin of the voice coil is attached. Therefore, a loudspeaker vibration system can be stably produced such that the outer circumference end portion of the cone diaphragm is coupled closely to the dome diaphragm, and the bobbin of the voice coil is coupled closely to the dome diaphragm. As a result, with the loudspeaker according to the present invention, it is possible to reduce the possibility of occurrence of the problems that the back surface side of the dome diaphragm and the bobbin of the voice coil are spaced apart, that the outer circumference end portion of the dome diaphragm and the outer circumference end portion of the cone diaphragm are spaced apart, or that the dome diaphragm or the cone diaphragm is coupled in a deformed state with a stress being applied.

Further, in the vibration system of the loudspeaker according to the present invention, the cone diaphragm is further provided with a plurality of through holes in the vicinity of the inner circumference end portion of the cone diaphragm, and therefore a space formed by closely coupling the dome diaphragm, the cone diaphragm, and the bobbin of the voice coil is not hermetically sealed. Accordingly, a solvent contained in the applied adhesive may not be confined in this space and the adhesive can be strongly hardened, thereby eliminating problems of deformation of the vibration system due to the presence of the solvent, and of the adhesive coming into the magnetic gap of the magnetic circuit when assembling the diaphragm. Thus, it is possible to stably provide a loudspeaker having excellent playback sound quality.

DETAILED DESCRIPTION OF THE PREFERRED EMBODIMENTS

The following specifically describes preferred embodiments according to the present invention with reference to the drawings. However, the present invention is not limited to these embodiments.

Embodiment 1

Figure 1:
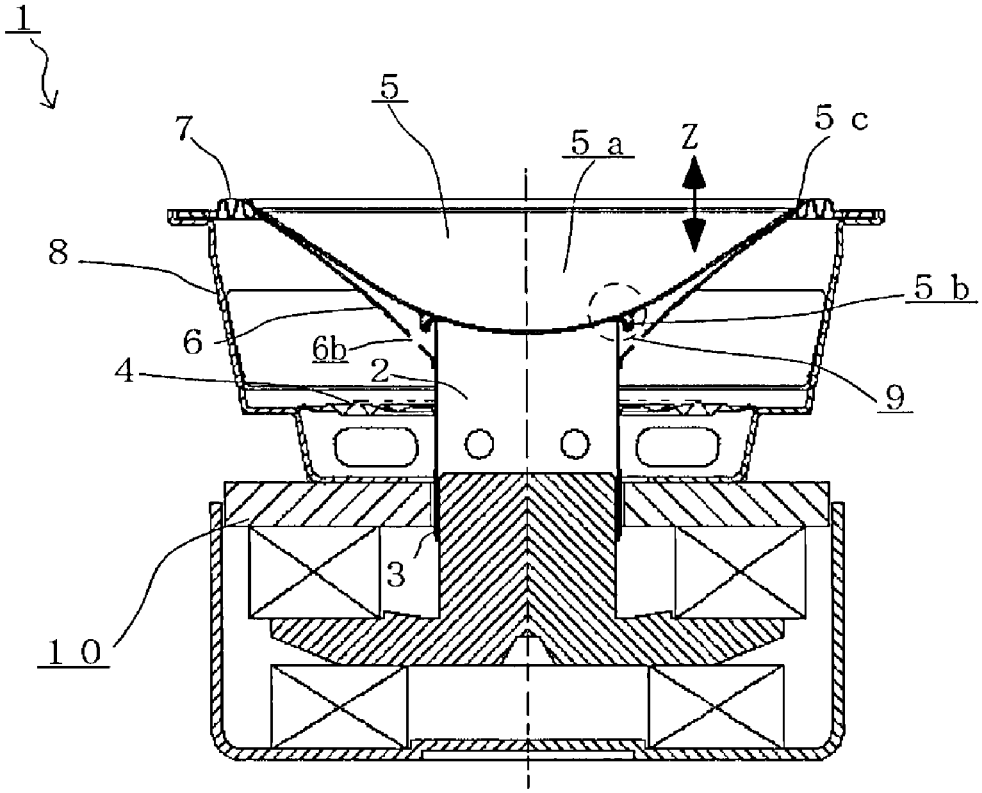
FIG. 1 is a diagram showing a loudspeaker 1 according to a preferred embodiment of the present invention (Embodiment 1)

FIG. 1 is a schematic cross-sectional view of a loudspeaker 1 according to a preferred embodiment of the present invention. The loudspeaker 1 is an electrodynamic loudspeaker with an aperture diameter of 8 cm, and includes a dome diaphragm 5, a cone diaphragm 6 whose outer circumference side end portion is coupled to an outer circumference end portion of the dome diaphragm 5, a voice coil bobbin 2 whose one end is coupled to a back surface of the dome diaphragm 5 and whose outer curved surface is coupled with an inner circumference end portion of the cone diaphragm 6, and a voice coil 3 that is wound about a lower end portion of the voice coil bobbin 2. The voice coil 3 is provided in a magnetic gap of a magnetic circuit 10, and drives a vibration system of the loudspeaker 1 in response to an input signal by being displaced within the magnetic gap. The vibration system constituted by the dome diaphragm 5, the cone diaphragm 6, and the voice coil bobbin 2 is vibratably supported by a damper 4 and an edge 7 along a Z direction as shown in the drawing. Further, a coupling portion 9 to which the voice coil bobbin 2 is attached is defined on a side of the back surface of the dome diaphragm 5, as described later.

The voice coil bobbin 2 is made of a polyimide film that is 0.075 mm thick, for example, and formed into a cylindrical shape with a diameter of about 19.4 mm as a whole, with the voice coil 3 winding about its lower end portion, and reinforcing paper wrapping around an outer curved surface about which the voice coil 3 is not wound. Other examples of the material of which the voice coil bobbin 2 can be formed include duralumin, silter, kapton, or such. The lead wires (not shown) are soldered and fixed to the voice coil 3, and sound signal current is supplied to the voice coil 3 through these lead wires. Note that a height of the voice coil bobbin 2 is about 23.5 mm, and its tolerance 2*h* is ±0.2 mm. Further, radius tolerance 2*r* of the voice coil bobbin 2 is ±0.1 mm.

To an outer curved surface of the voice coil bobbin 2, an inner diameter end of the damper 4 is coupled with adhesive. An outer diameter end of the damper 4 is fixed to a damper fixing portion of a frame 8 with adhesive. The damper 4 can be a circular corrugation damper made of woven fabric, as a base material, of fibers having flexibility impregnated in a phenol resin, or can be made of a different material. For example, the damper 4 can be a butterfly damper made of a metal or a resin and having an arm coupling an inner circumference side ring and an outer circumference side ring. Further, the frame 8 is made of an iron plate that has been pressure molded into a basket shape according to the shape of the dome diaphragm 5.

The cone diaphragm 6 is made of, for example, a paper material formed by papermaking, and is a substantially cone shaped diaphragm with an inner diameter of about 20.0 mm, an outer diameter of about 57.5 mm, and a height of about 16.5 mm. Height tolerance 6*h* of the cone diaphragm 6 is ±0.3 mm. The inner diameter end of the cone diaphragm 6 is coupled to the outer curved surface of the voice coil bobbin 2 with adhesive. Four through holes 6*b* each having diameter of 5.0 mm are provided in a concentric pattern in the vicinity of the inner circumference end portion of the cone diaphragm 6. Further, an outer diameter end of the cone diaphragm 6 is adhered to the edge 7 having corrugation. In this embodiment, an inner circumference end portion of the edge 7 is bonded over a front side of the outer diameter end of the cone diaphragm 6. The edge 7 has a corrugated movable supporting portion, and the corrugation defines an annular recess viewed from a front side. The edge 7 is fixed, on an outer circumference end side, to an edge fixing portion of the frame 8 with adhesive.

The dome diaphragm 5 is an inversed dome-shaped diaphragm having a smooth recess when viewing the loudspeaker 1 from a front side, and the coupling portion 9 to which the voice coil bobbin 2 is attached is defined on a central portion on the back surface side of the dome diaphragm 5. Further, the outer diameter portion of the cone diaphragm 6 is coupled to the back surface side of the outer circumference portion. The dome diaphragm 5 can more smoothly transmit a driving force produced in the voice coil 3 through the voice coil bobbin 2 and the cone diaphragm 6, and therefore a transmission loss of the driving force can be prevented. It should be noted that the back surface side of the dome diaphragm 5 indicates a side on which the voice coil bobbin 2 of the dome diaphragm 5 and the cone diaphragm 6 are adhered. As the coupling portion 9 is provided on the back surface side of the dome diaphragm 5 instead of a front surface side of the dome diaphragm 5, the coupling portion 9 is not exposed at the front surface side, providing the dome diaphragm 5 with esthetically excellent appearance.

Figure 2A:
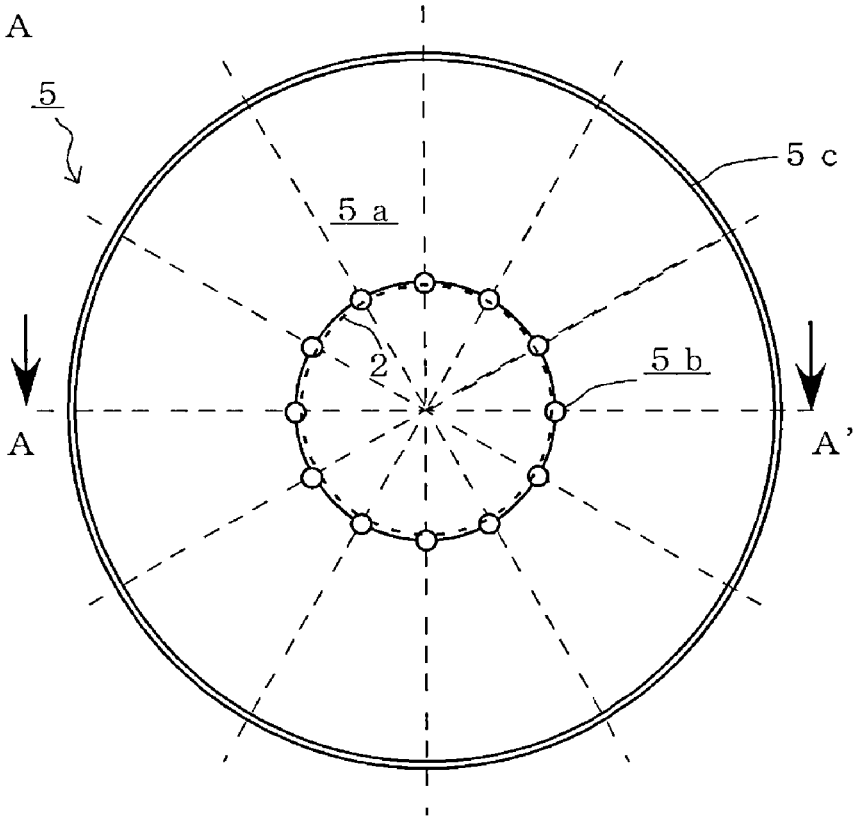
FIGS. 2A to 2C are enlarged views of a main portion showing a dome diaphragm 5 that constitutes the loudspeaker 1 according to the preferred embodiment of the present invention (Embodiment 1)
Figure 2B:
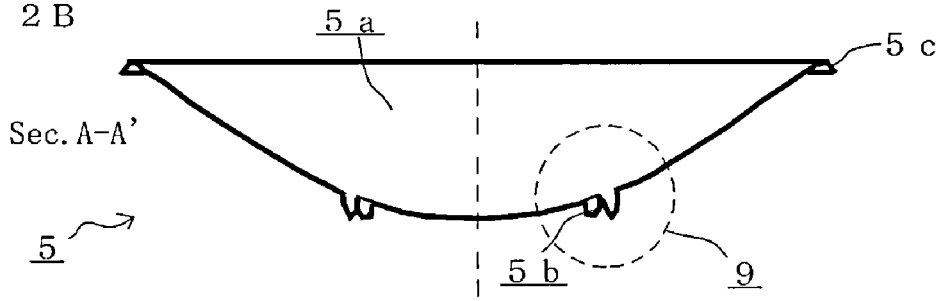
Figure 2C:
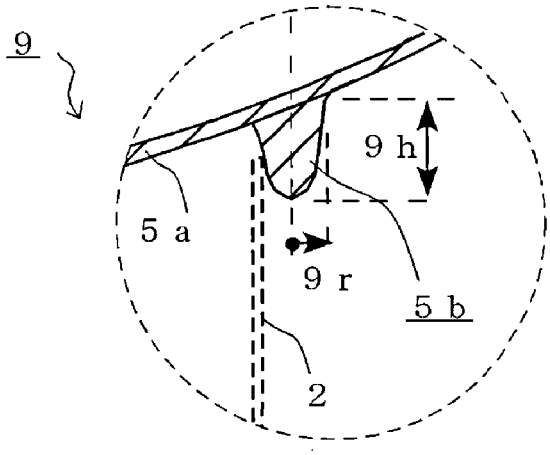

FIGS. 2A to 2C are enlarged views of a main portion illustrating the dome diaphragm 5 that constitutes the loudspeaker 1 of this embodiment. FIG. 2A is a plan view of the dome diaphragm 5 viewed from the back surface side, FIG. 2B is a cross-sectional view taken along line A-A' illustrating a cross-sectional shape of the dome diaphragm 5, and FIG. 2C is a partially enlarged cross-sectional view illustrating the coupling portion 9 of the dome diaphragm 5. In FIG. 2A and FIG. 2C, the shape of the voice coil bobbin 2 coupled to the coupling portion 9 is shown by a dotted line.

In this embodiment, a diaphragm section 5*a* of the dome diaphragm 5 is made of a base material impregnated in a thermosetting resin. For example, the base material is a laminated body including a natural fiber woven fabric layer and a natural fiber nonwoven fabric layer. Although any suitable thermosetting resin can be employed, it is preferable to use unsaturated polyester as the thermosetting resin because production of the diaphragm section 5*a* from unsaturated polyester is easy and allows an excellent internal loss for the diaphragm section 5*a* due to a high curing speed and a low curing temperature. The aperture diameter of the dome diaphragm 5 of this embodiment is about 6 cm, an entire height is about 13 mm, and an average thickness t of the diaphragm is about 0.3 mm excluding the coupling portion 9 that will be described later. In addition, height tolerance 5*h* of the dome diaphragm 5 is ±0.3 mm.

The base material of the dome diaphragm 5 can be according to the application and intended purpose, any suitable woven fabric or nonwoven fabric can be employed. The base material can be made of only one of the woven fabric and the nonwoven fabric, or can be a laminated body including either a plurality of nonwoven fabric or the woven fabric and nonwoven fabric. Examples of the nonwoven fabric typically include p-aramid fiber, m-aramid fiber, rayon fiber, cotton fiber, ultrahigh-strength polyethylene fiber, and polyallylate fiber. Examples of the woven fabric include polymethylene (trimethylene) terephthalate and polyethylene naphthalate (PEN) fiber. Further, the fiber included in the woven fabric or the nonwoven fabric can be natural fibers as described above, or can be inorganic fibers.

An engagement flange 5*c* containing either the base material or the thermosetting resin is formed along the outer circumference end portion of the diaphragm section 5*a* of the dome diaphragm 5. The engagement flange 5*c* can be a flange formed extending horizontally along the outer circumference side end portion of the diaphragm section 5*a*, or can be a flange folded back to a side facing away from the protruded portion of the inverted dome shape of the diaphragm section 5*a* in this embodiment. In the case of this embodiment, when constructing the vibration system as the loudspeaker 1, the engagement flange 5*c* of the dome diaphragm 5 engages with the annular recess of the movable supporting portion defined by the corrugation of the edge 7. Specifically, the outer circumference end portion of the vibration system constituted by the cone diaphragm 6 and the edge 7 engages with an edge portion defined by the engagement flange 5*c* of the dome diaphragm 5. The engagement of the engagement flange 5*c* of the dome diaphragm 5 with the annular recess defined by the corrugation of the edge 7 in a step of adhering the dome diaphragm 5 allows the dome diaphragm 5 to be adhered to the voice coil bobbin 2 and the cone diaphragm 6 without being slanted. It should be noted that, in the case of this embodiment, as the inner circumference end portion of the edge 7 is bonded over the front side of the outer circumference end of the cone diaphragm 6, the engagement flange 5*c* of the dome diaphragm 5 engages with the annular recess defined by the corrugation of the edge 7. Accordingly, an outer circumference side end portion of the dome diaphragm and the outer circumference end portion of the cone diaphragm 6 are coupled so as to sandwich the inner circumference end portion of the edge 7 therebetween.

The outer circumference side end portion of the dome diaphragm 5 and the outer circumference end portion of the cone diaphragm 6 can be coupled with adhesive with the edge 7 interposed therebetween as described above, or can be coupled directly with adhesive. For example, when, in another embodiment, the inner circumference end portion of the edge 7 is bonded over the back surface side of the outer circumference end of the cone diaphragm 6, the engagement flange 5*c* of the dome diaphragm 5 is engaged with the outer circumference end portion of the cone diaphragm 6. In this manner, the dome diaphragm 5 is adhered to the voice coil bobbin 2 and the cone diaphragm 6 without being slanted.

The coupling portion 9 of the dome diaphragm 5 is defined by a plurality of cone-shaped projections 5*b* disposed in a circular pattern with a space between each other. The cone-shaped projections 5*b* are projections that are in a substantial cone shape and formed by hardening the thermosetting resin, projecting from the back surface side of the diaphragm section 5*a* of the dome diaphragm 5. Specifically, the cone-shaped projections 5*b* is made preferably by unsaturated polyester without containing the base material, as production of the coupling portion 9 from unsaturated polyester is easy and allows an excellent internal loss for the coupling portion 9 due to a high curing speed and a low curing temperature. The coupling portion 9 can be produced in an extremely simple manner as the thermosetting resin is dripped to a portion of a metal mold that is shaped in the shape of the coupling portion 9 and then hardened, at the same time as the base material of the diaphragm section 5*a* is impregnated in thermosetting resin.

Specifically, the cone-shaped projections 5*b* that constitutes the coupling portion 9 has a cone diameter of about 1.5 mm at a boundary line with the diaphragm section 5*a*, which indicates, in other words, a cone radius 9*r* of the cone-shaped projections 5*b* is about 0.75 mm. Further, a cone height 9*h* of the cone-shaped projection 5*b* is about 1.5 mm, and a top of the cone is chamfered to provided a spherical surface in the vicinity of the top. Twelve cone-shaped projections 5*b* are disposed on the back surface side of the diaphragm section 5*a* at an interval of 30 degrees to each other along a concentric circle with a diameter of 21.7 mm that is greater than the diameter of the voice coil bobbin 2.

The height 9*h* of each cone-shaped projection 5*b* is 1.5 mm, being set so as to be greater than a total sum of maximum values of absolute values of the height tolerance 5*h* of the dome diaphragm 5, the height tolerance 6*h* of the cone diaphragm 6, and the height tolerance 2*h* of the voice coil bobbin 2, which is, in the case of this embodiment, 0.8 mm (=(5h+6h+2h) mm). Further, the cone radius 9*r* defining each cone-shaped projection 5*b* is 0.75 mm, being set so as to be greater than a maximum value of an absolute value of radius tolerance of the voice coil bobbin 2, tolerance 2*r*.

For the loudspeaker 1 according to this embodiment, the vibration system of the loudspeaker is structured such that the dome diaphragm 5 is coupled with the outer circumference end portion of the cone diaphragm 6 by closely adhered, and the dome diaphragm 5 is coupled with the voice coil bobbin 2 by closely adhered. This is because the coupling portion 9 that is formed on the dome diaphragm 5 and with which the one end of the voice coil bobbin 2 is coupled is defined by a position of the cone-shaped projections 5*b* determined in consideration of the tolerance of each component and assembly tolerance of the components. In other words, the plurality of cone-shaped projections 5*b* are provided along a concentric circle whose diameter is greater than the diameter of the voice coil bobbin 2, and thus a part of the cylinder of the voice coil bobbin 2 is brought into contact with the conical surface of any of the plurality of cone-shaped projections 5*b* even if the voice coil bobbin 2 is offset from the center when assembling the components that constitute the vibration system or even if the voice coil bobbin 2 is partially deformed. Accordingly, the back surface side of the dome diaphragm 5 and the voice coil bobbin 2 may not be spaced apart. This consequently allows a stable production of the vibration system for the loudspeaker by coupling using an adhesive.

Figure 3A:
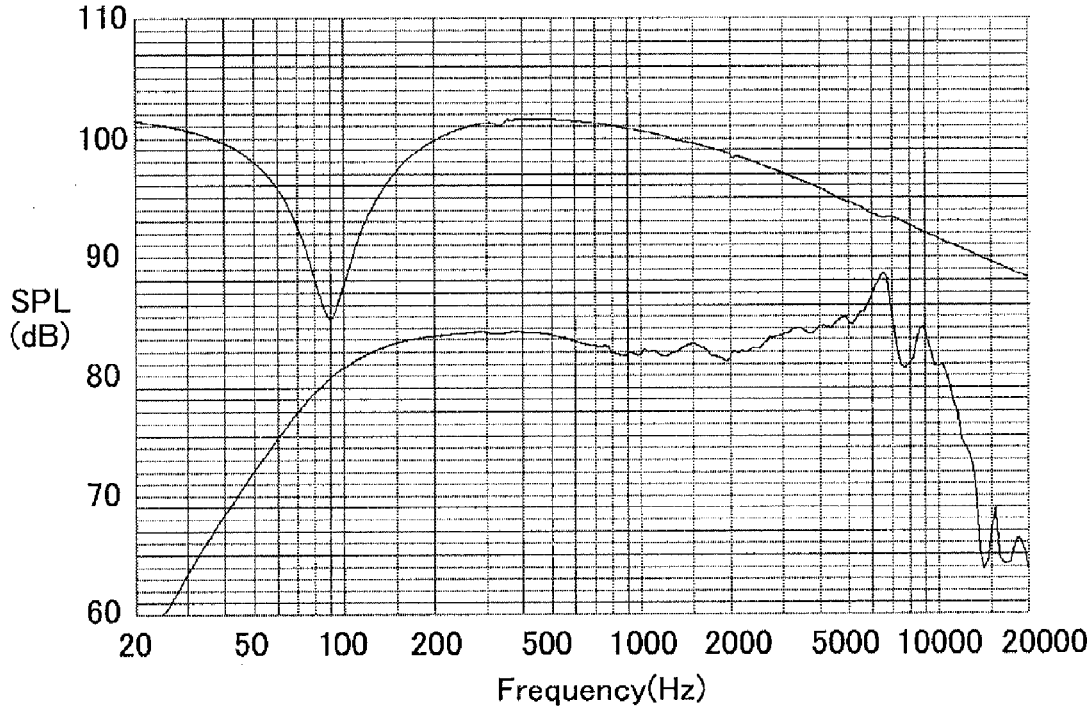
FIGS. 3A and 3B are graphs showing acoustic characteristics of the loudspeaker 1 according to the preferred embodiment of the present invention (Embodiment 1)
Figure 3B:
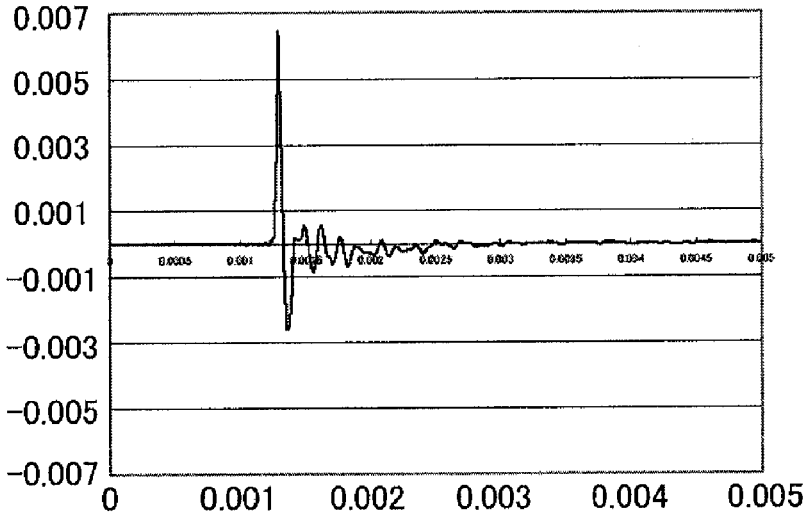

FIGS. 3A and 3B show graphs illustrating acoustic characteristics of the loudspeaker 1 according to this embodiment. FIG. 3A is a graph showing sound pressure frequency characteristics in the vicinity (0.05 m along an axis) of the dome diaphragm 5 of the loudspeaker 1, along with admittance characteristics representing an amount of current supplied to the voice coil 3. FIG. 3B is a graph showing a wave profile along time axis representing an impulse response. As can be seen from these graphs, in the case of the loudspeaker 1 according to this embodiment, a frequency at which a resonance at a higher mode is generated can be increased up to about 6 kHz or higher. Further, it can be seen from the impulse response that the loudspeaker 1 is quickly damped and has less tones of unique resonance frequencies. The loudspeaker 1 is configured such that the dome diaphragm 5 is coupled in close contact with the outer circumference end portion of the cone diaphragm 6, and the dome diaphragm 5 is coupled in close contact with the voice coil bobbin 2. This provides an extremely solid structure for the vibration system, and consequently, realizes flat frequency characteristics with little peak dip, thereby improving playback sound quality.

Figure 4A:
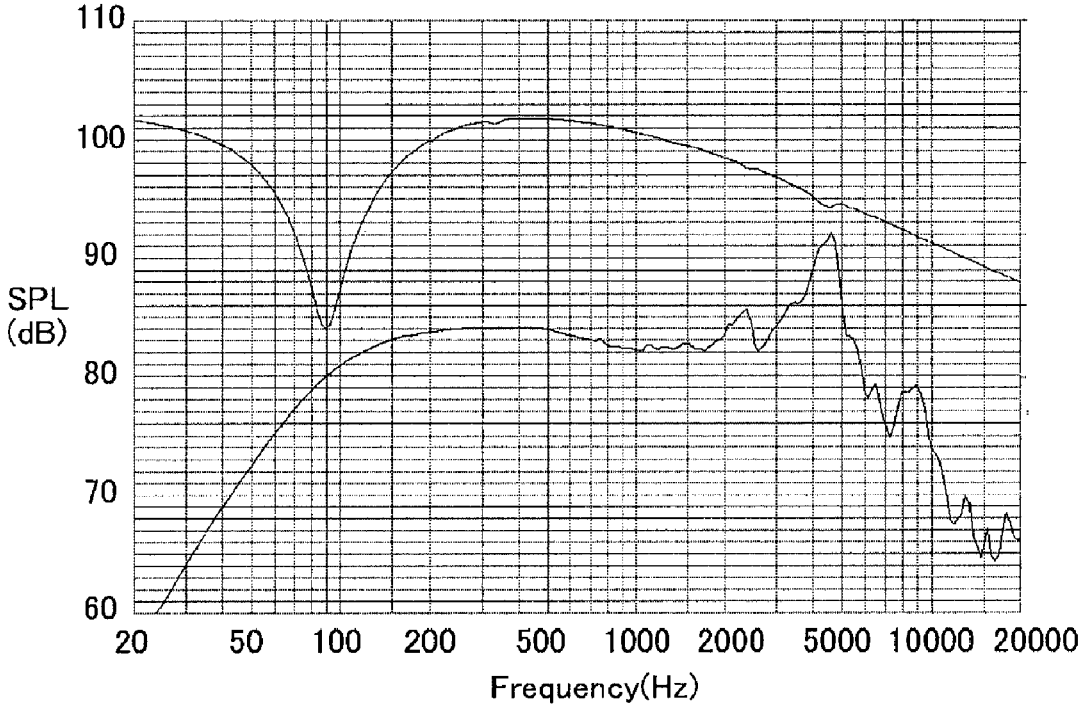
FIGS. 4A and 4B are graphs showing acoustic characteristics of a loudspeaker 11 according to a comparative example (Comparative Example 1)
Figure 4B:
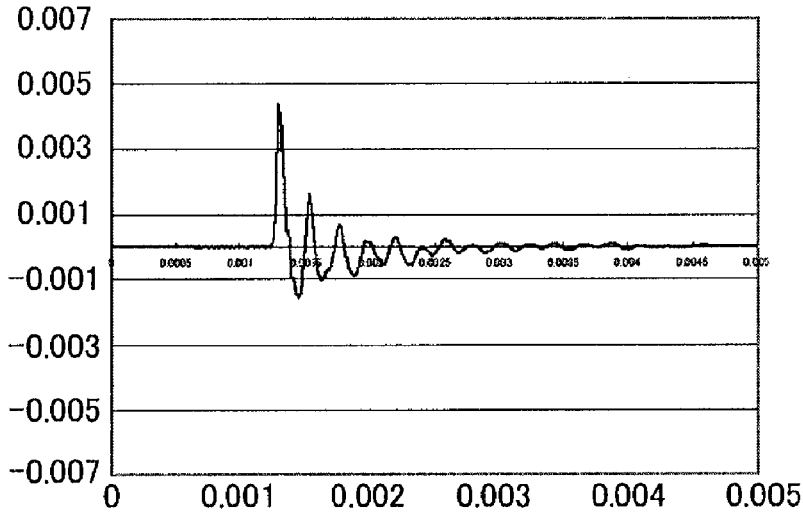
Figure 5A:
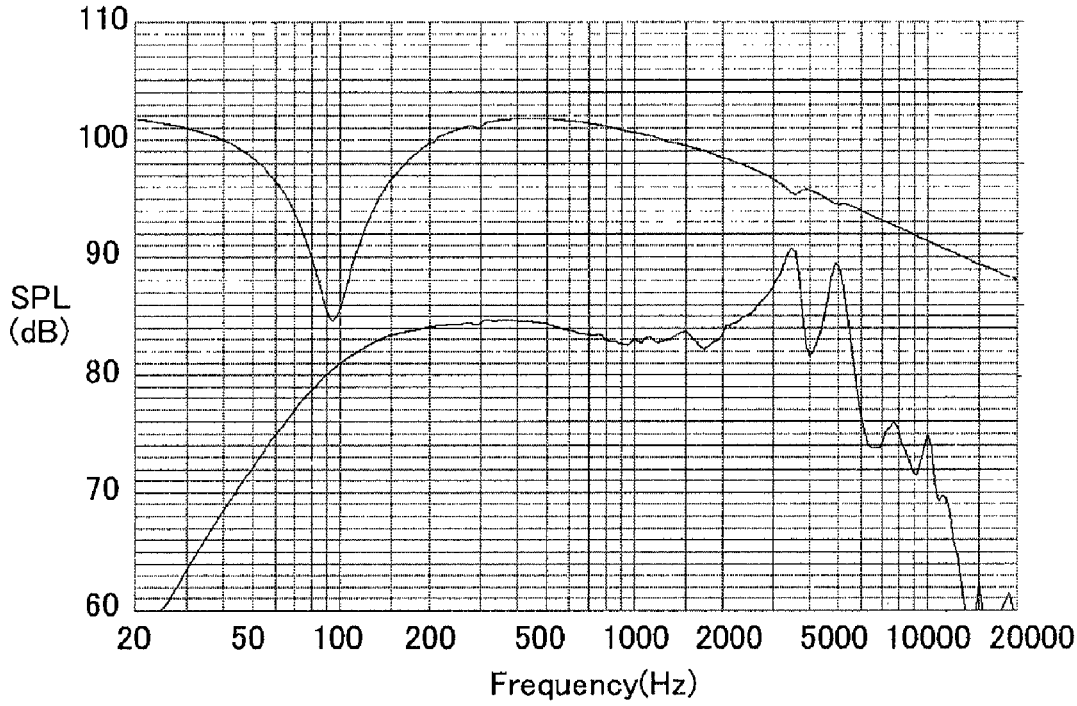
FIGS. 5A and 5B are graphs showing acoustic characteristics of a loudspeaker 12 according to a comparative example (Comparative Example 2)
Figure 5B:
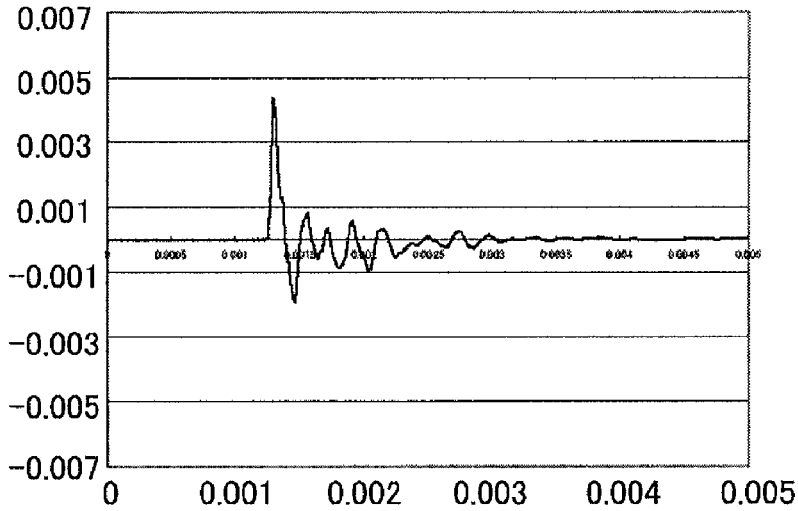

FIGS. 4A, 4B and FIGS. 5A, 5B are graphs illustrating acoustic characteristics of a loudspeaker 11 (not shown) and a loudspeaker 12 (not shown) of comparative examples. FIG. 4A is a graph showing sound pressure frequency characteristics in the vicinity (0.05 m along an axis) of a diaphragm of the loudspeaker 11 according to one comparative example, along with admittance characteristics representing an amount of current supplied to the voice coil 3. FIG. 4B is a graph showing a wave profile along time axis representing an impulse response. Further, FIG. 5A is a graph showing sound pressure frequency characteristics in the vicinity (0.05 m along an axis) of a diaphragm of the loudspeaker 12 according to another comparative example, along with admittance characteristics representing an amount of current supplied to the voice coil 3. FIG. 5B is a graph showing a wave profile along time axis representing an impulse response. The same conditions of measurement are used as in the case of the loudspeaker 1 according to this embodiment shown in FIG. 3.

The loudspeaker 11 (not shown) of the one comparative example has substantially the same structure as that of the loudspeaker 1, other than that a dome diaphragm 15 (not shown) is different. Specifically, the loudspeaker 11 is different from the loudspeaker 1 in that the dome diaphragm 15 of the loudspeaker 11 of the comparative example is not provided with a plurality of cone-shaped projections that project on a side of a back surface, thus providing a vibration system in which the back surface side of the dome diaphragm 15 and the voice coil bobbin 2 are spaced apart. In other words, while the dome diaphragm 15 is coupled in close contact with the outer circumference end portion of the cone diaphragm 6, the dome diaphragm 15 is not coupled in close contact with the voice coil bobbin 2, and therefore the strength of the vibration system is deteriorated. As can be seen from the graphs of FIGS. 4A and 4B, with the loudspeaker 11 of the comparative example, a frequency at which a resonance at a higher mode is generated is reduced down to about 2.3 kHz, and a range demonstrating flat frequency characteristics with little peak dip is smaller. Further, it can be seen from the impulse response of the loudspeaker 11 of the comparative example that unique resonance frequencies are slowly damped and remain for a long time, posing a problem for the loudspeaker in toning.

The loudspeaker 12 (not shown) of the other comparative example also has substantially the same structure as that of the loudspeaker 1 of this embodiment. Although the loudspeaker 12 also includes the dome diaphragm 5, the cone diaphragm 6 is not provided. Specifically, the loudspeaker 12 of the comparative example is different from the loudspeaker 1 in that while the loudspeaker 12 is provided with the plurality of cone-shaped projections 5*b* projecting from the back surface side of the dome diaphragm 5, and being coupled to the voice coil bobbin 2 and the coupling portion 9, a cone diaphragm that is coupled to the outer circumference end portion of the dome diaphragm 5 is not provided. In other words, the vibration system of the loudspeaker 12 of this comparative example is configured such that only the voice coil bobbin 2 is coupled in close contact with the dome diaphragm 5. Accordingly, similarly to the case of the loudspeaker 11 of the comparative example, the strength of the vibration system of the loudspeaker 12 of the comparative example is deteriorated. As can be seen from the graphs of FIGS. 5A and 5B, with the loudspeaker 12 of the comparative example, a frequency at which a resonance at a higher mode is generated is reduced down to about 1.5 kHz, and a range demonstrating flat frequency characteristics with little peak dip is smaller. Further, it can be seen from the impulse response of the loudspeaker 12 of the comparative example that unique resonance frequencies are slowly damped and remain for a long time, posing a problem for the loudspeaker in toning.

As described above, in the case of the loudspeaker 1 of this embodiment, it is possible to provide a loudspeaker that realizes flat frequency characteristics and has a favorable impulse response where the unique resonance is quickly damped, thereby demonstrating excellent playback sound quality. As the vibration system of the loudspeaker is configured such that the outer circumference end portion of the cone diaphragm 6 is coupled in close contact with the dome diaphragm 5 and the voice coil bobbin 2 is coupled in close contact with the dome diaphragm 5, neither the dome diaphragm 5 nor the cone diaphragm 6 is coupled to the voice coil bobbin 2 with adhesive in a deformed state with a stress being applied. Thus, it is possible to stably provide a loudspeaker having excellent playback sound quality.

For the loudspeaker 1 of this embodiment, four through holes 6*b* with a diameter of 5.0 mm are provided in a concentric pattern on the inner circumference end portion of the cone diaphragm 6. When coupling the voice coil bobbin 2, the dome diaphragm 5, and the cone diaphragm 6 that constitute the vibration system of the loudspeaker 1 with adhesive, it is preferable to further provide the through holes 6*b* because a problem may occur in assembling if a space enclosed by the voice coil bobbin 2, the dome diaphragm 5, and the cone diaphragm 6 is hermetically sealed. The through holes 6*b* communicate the space enclosed by the dome diaphragm 5, the cone diaphragm 6, and the voice coil bobbin 2 with an external space. As a result, a solvent contained in the adhesive applied to the vibration system may not be confined in this space, thereby eliminating a problem that the components that constitute the vibration system are deformed due to the presence of the solvent.

Further, while the cone diaphragm 6 according to this embodiment contains the paper material formed by papermaking, the cone diaphragm 6 can be made of the base material impregnated in thermosetting resin, similarly to the diaphragm section 5*a* of the dome diaphragm 5. In the loudspeaker 1, the outer circumference end portion of the cone diaphragm 6 is closely coupled to the dome diaphragm 5, and the voice coil bobbin 2 is closely coupled to the dome diaphragm 5, thereby increasing rigidity of the vibration system. Accordingly, it is possible to realize weight reduction using the cone diaphragm 6 made of the base material impregnated in thermosetting resin, similarly to the case of the dome diaphragm 5.

Further, providing the through holes 6*b* for the inner circumference end portion of the cone diaphragm 6 can reduce the possibility of a problem in a step of assembling the vibration system such that the applied adhesive comes into the magnetic gap of the magnetic circuit 10. If the space enclosed by the cone diaphragm 6 is hermetically sealed, when mounting the dome diaphragm 5 on the cone diaphragm 6, air between the dome diaphragm 5 and the cone diaphragm 6 is compressed and can only escape to the magnetic gap of the magnetic circuit 10, and the adhesive disadvantageously comes inside the cylinder of the voice coil bobbin 2 or into the magnetic gap. In the loudspeaker 1 according to this embodiment, the problem that the adhesive comes into the magnetic gap of the magnetic circuit 10 can be prevented, and thus it is possible to stably provide a loudspeaker having excellent playback sound quality.

Embodiment 2

Figure 6A:
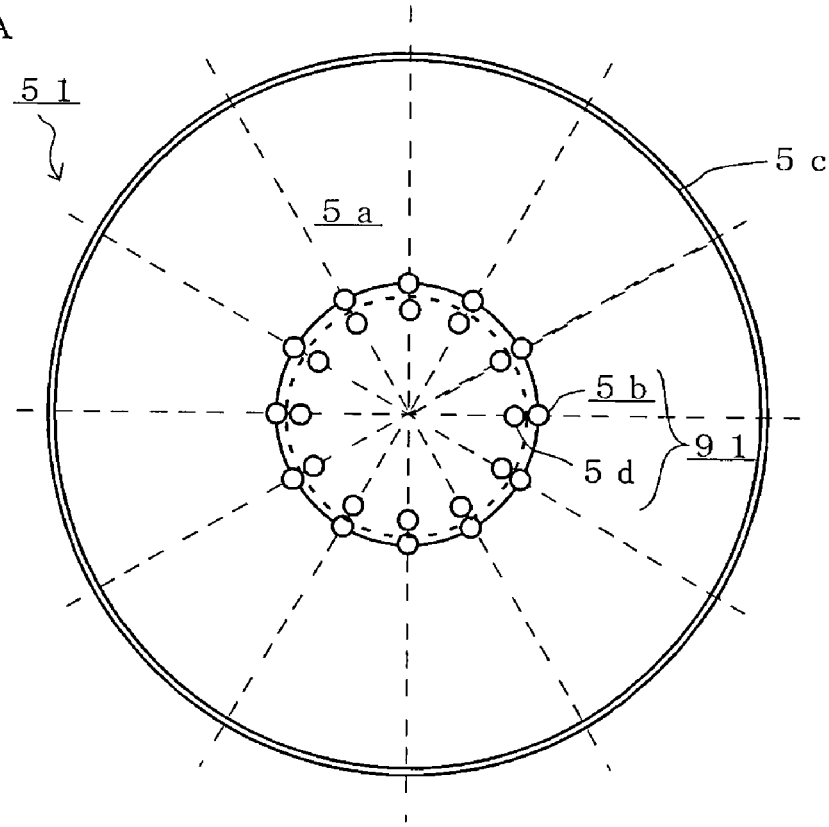
FIGS. 6A and 6B are diagrams showing dome diaphragms 51 and 52 that constitute a loudspeaker (not shown) according to a different embodiment of the present invention (Embodiment 2).
Figure 6B:
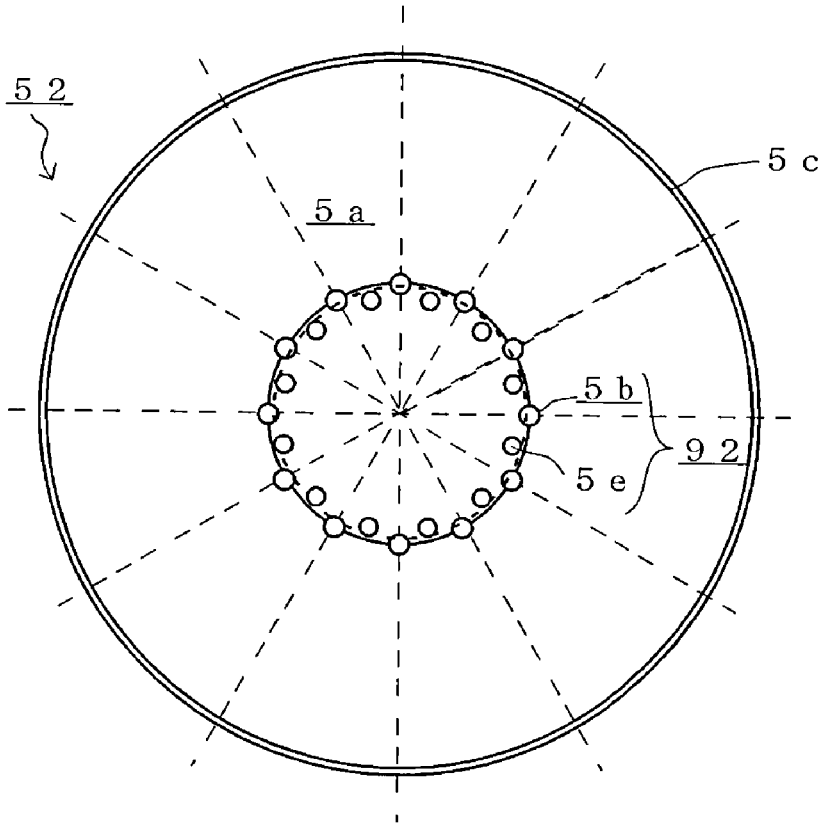

FIGS. 6A and 6B are diagrams illustrating dome diaphragms 51 and 52 each constituting a loudspeaker (not shown) of a different embodiment according to the present invention. This embodiment is substantially the same as the previously described embodiment 1, other than that an arrangement of the plurality of cone-shaped projections 5*b* defining the coupling portion 9 between the dome diaphragm 5 and the voice coil bobbin 2 is different. Accordingly, the like components are designated by the same numerals and descriptions for these components are not repeated. FIG. 6A is a plan view of the dome diaphragm 51 viewed from the back surface side, and FIG. 6B is a plan view of the dome diaphragm 52 viewed from the back surface side.

As shown in FIG. 6A, a coupling portion 91 of the dome diaphragm 51 that constitutes the loudspeaker of the different embodiment is defined by the plurality of cone-shaped projections 5*b* that are disposed in a circular pattern with a space between each other, and a plurality of cone-shaped projections 5*d* that are disposed in a circular pattern, inside the cone-shaped projections 5*b*, with a space between each other. Similarly to the cone-shaped projections 5*b*, the cone-shaped projections 5*d* are projections that are in a substantial cone shape and formed by hardening the thermosetting resin, projecting from the back surface side of the diaphragm section 5*a* of the dome diaphragm 5. The cone-shaped projections 5*b* and 5*d* are substantially in the same shape and positioned close to each other, and are made preferably by unsaturated polyester without containing the base material. Twelve cone-shaped projections 5*d* are disposed at an interval of 30 degrees along a concentric circle having a diameter of 17.8 mm that is smaller than the diameter of the voice coil bobbin 2.

Further, as shown in FIG. 6B, a coupling portion 92 of the dome diaphragm 52 that constitutes the loudspeaker of the different embodiment is defined by the plurality of cone-shaped projections 5*b* that are disposed in a circular pattern with a space between each other, and a plurality of cone-shaped projections 5*e* that are disposed in a circular pattern, inside the cone-shaped projections 5*b*, with a space between each other. Although the cone-shaped projections 5*e*, similarly to the cone-shaped projections 5*d* of the previously described embodiment, are disposed inside the cone-shaped projections 5*b* along a concentric circle, the cone-shaped projections 5*e* are disposed so as to be positioned between the two cone-shaped projections 5*b*. Also, twelve cone-shaped projections 5*e* are disposed at an interval of 30 degrees along a concentric circle having a diameter of 17.8 mm that is smaller than the diameter of the voice coil bobbin 2.

For the loudspeaker (not shown) according to this embodiment that employs the dome diaphragms 51 and 52, the vibration system of the loudspeaker is also configured such that the outer circumference end portion of the cone diaphragm 6 is coupled closely to the dome diaphragm, and the voice coil bobbin 2 is coupled closely to the dome diaphragm. In the case of the dome diaphragms 51 and 52 of this embodiment, the coupling portion 91 and 92 to which the one end of the voice coil bobbin 2 is coupled is defined by a position of the cone-shaped projections 5*b* determined in consideration of the of the tolerance of each component and assembly tolerance of the components, and restricts the coupling position so as to sandwich the voice coil bobbin 2. This is because the plurality of cone-shaped projections 5*b* are provided along a concentric circle whose diameter is greater than the diameter of the voice coil bobbin 2, and the plurality of cone-shaped projections 5*d* and 5*e* are provided along a concentric circle whose diameter is smaller than the diameter of the voice coil bobbin 2, and thus, a part of the cylinder of the voice coil bobbin 2 is brought into contact with the conical surface of any of the plurality of cone-shaped projections 5*b* and is further brought into contact with the conical surface of any of the cone-shaped projections 5*d* and 5*e* even if the voice coil bobbin 2 is offset from the center when assembling the components that constitute the vibration system or even if the voice coil bobbin 2 is partially deformed. Accordingly, the back surface side of the dome diaphragms 51 and 52 and the voice coil bobbin 2 may not be spaced apart. This consequently allows a stable production of the vibration system for the loudspeaker by coupling using an adhesive.

While the preferred embodiments of the present invention have been described above, the present invention is not limited to these embodiments. For the loudspeaker according to the present invention including the dome diaphragm that is made of the base material impregnated in the thermosetting resin; the cone diaphragm whose outer circumference side end portion is coupled with the outer circumference end portion of the dome diaphragm; and the voice coil having the bobbin whose one end is coupled to a back surface of the dome diaphragm, and whose outer curved surface is coupled with an inner circumference end portion of the cone diaphragm can have any size and arrangement for the, cone-shaped projections, as long as the dome diaphragm is provided with a plurality of cone-shaped projections that is formed by hardening the thermosetting resin, projecting from the back surface, and disposed in a circular pattern with a space between each other, the plurality of cone-shaped projections defining a coupling portion to which the one end of the bobbin is coupled.

However, it is not desirable that the plurality of cone-shaped projections are shaped in a large rib. It is preferable that the cone-shaped projections are provided in a circular pattern with a space between each other. It is also preferable that the number of the cone-shaped projections is more than one, as needed for defining the coupling portion, and can be at least three, and it is more preferable to provide a smaller number of the cone-shaped projections. The loudspeaker according to the present invention using the dome diaphragm made of the base material impregnated in the thermosetting resin can reduce the weight of the dome diaphragm because the diaphragm section 5*a* contains the base material and the cone-shaped projections are made of the resin, unlike other resin diaphragms made by injection molding. Thus, it is possible to stably provide a loudspeaker having excellent playback sound quality.

The vibration system of the loudspeaker according to the present invention can be suitably utilized for loudspeakers that are used in many applications (household use and automobile use). Further, the vibration system of the loudspeaker according to the present invention can be used for any loudspeaker such as woofers that produces sound in a low frequency range, and tweeters that produces sound in a high frequency range. The vibration system of the loudspeaker is not limited to the electrodynamic loudspeaker, and can be applied to a loudspeaker having a piezoelectric device. Further, the vibration system of the present invention can be applied not only to the loudspeakers, but to microphones.

What is claimed is:

1. A loudspeaker comprising:

a inversed dome-shaped diaphragm having a recess viewed from a front side, that is made of a base material impregnated in a thermosetting resin;

a cone diaphragm whose outer circumference side end portion is coupled with an outer circumference end portion of the dome diaphragm; and a voice coil having a bobbin whose one end is coupled to a back surface of the dome diaphragm, and whose outer curved surface is coupled with an inner circumference end portion of the cone diaphragm, wherein the dome diaphragm is provided with a plurality of cone-shaped projections that is formed by hardening the thermosetting resin, projecting from the back surface, and disposed in a circular pattern with a space between each other, the plurality of cone-shaped projections defining a coupling portion to which the one end of the bobbin is coupled, a height of each of the plurality of cone-shaped projections provided for the dome diaphragm is set greater than a sum of maximum values of absolute values respectively of height tolerance of the dome diaphragm, height tolerance of the cone diaphragm, and height tolerance of the bobbin of the voice coil, and a cone radius defining each cone-shaped projection is set greater than a maximum value of an absolute value of radius tolerance of the bobbin.

2. The loudspeaker according to claim 1, further comprising:

an edge whose inner circumference end portion is coupled to the outer circumference end portion of the cone diaphragm;

a damper whose inner circumference end portion is coupled to the outer curved surface of the bobbin of the voice coil;

a frame to which the outer circumference end portion of the edge and the outer circumference end portion of the damper are coupled; and a magnetic circuit to which the frame is coupled, the magnetic circuit having a magnetic gap in which a coil of the voice coil is provided.

3. The loudspeaker according to claim 2, wherein the dome diaphragm is further provided with an engagement flange along the outer circumference end portion, the engagement flange engaging with one of the outer circumference end portion of the cone diaphragm and an annular recess defined by a movable supporting portion of the edge.

4. The loudspeaker according to claim 1, wherein the cone diaphragm is further provided with a plurality of through holes in the vicinity of the inner circumference end portion of the cone diaphragm.

5. The loudspeaker according to claim 1, wherein the base material of the dome diaphragm contains one of woven fabric and nonwoven fabric made of fibers, and the thermosetting resin contains an unsaturated polyester resin.

* * * * *